United States Patent [19]

Ferdinand et al.

[11] 4,330,113

[45] May 18, 1982

[54] VISE

[75] Inventors: Irwin J. Ferdinand, Glencoe; Richard Sylvan, Glenview; Michael Peterson, Evanston, all of Ill.

[73] Assignee: Hirsh Company, Skokie, Ill.

[21] Appl. No.: 141,073

[22] Filed: Apr. 29, 1980

[51] Int. Cl.[3] ..... B25B 1/10

[52] U.S. Cl. ..... 269/88; 269/97; 269/208; 269/244

[58] Field of Search ..... 182/129; 269/901, 208, 269/209, 97, 99–100, 261, 283, 139, 244, 88

[56] References Cited

U.S. PATENT DOCUMENTS

| | | | |
|---|---|---|---|
| 1,033,758 | 7/1912 | Howell | 269/99 X |
| 1,479,209 | 1/1924 | Topp | 269/901 X |
| 2,581,317 | 1/1952 | Zabich | 269/208 X |
| 4,121,814 | 10/1978 | Prior | 269/98 |
| 4,170,345 | 10/1979 | Townsend | 269/88 |
| 4,248,411 | 2/1981 | Wagster | 269/208 X |

FOREIGN PATENT DOCUMENTS

| | | | |
|---|---|---|---|
| 2707646 | 1/1977 | Fed. Rep. of Germany | 269/901 |

*Primary Examiner*—Robert C. Watson

*Attorney, Agent, or Firm*—Dressler, Goldsmith, Shore, Sutker & Milnamow, Ltd.

[57] ABSTRACT

A vise for use with sawhorses and workbenches in which swivel jaws having specially configured feet are detachably connected to an apertured channel. Advantageously, the jaws can be connected to either side or the top of the channel to position the workpiece either vertically or horizontally. In the preferred form, a movable box-like drive assembly carrying one of the jaws is driven by a threaded shaft upon rotation of a hand crank to move the driven jaw into clamping engagement with the workpiece.

5 Claims, 7 Drawing Figures

VISE

DESCRIPTION

1. Technical Field of the Invention

This invention relates to vises, and more particularly, to a vise for use with both sawhorses and workbenches.

2. Background of the Invention

Over the years a variety of clamping devices have been developed. Typifying some of these clamping devices are those shown in U.S. Pat. Nos. 114,800, 187,117, 487,106, 1,479,209, 1,529,281, 1,574,528, 2,043,140, 2,247,656, 2,407,743, 2,796,097, 2,969,817, 4,061,323, 4,073,484, and German Pat. Nos. 2458160, 2707646, and 2753689. These prior art clamping devices have met with varying degrees of success.

Prior art clamping devices and vises are not typically useable with both sawhorses and workbenches, nor do they usually permit the craftsman to clamp the workpiece both horizontally and vertically.

It is therefore desirable to provide an improved vise which overcomes the preceding disadvantages.

SUMMARY OF THE INVENTION

An improved vise is provided for use with both sawhorses and workbenches. The vise is easy to use, effective and efficient and permits the craftsman to securely clamp the workpiece in both a horizontal and a vertical position.

The novel vise has connection assemblies, such as two inverted U-shaped connectors, which can be used to removably mount a channel to the legs of a sawhorse so that the chanel extends across and provides the top of the sawhorse. The connector assemblies can also be used to removably mount the channel flush with the top of a workbench.

Jaws interlockingly and detachably engage the channel to clamp the workpiece. In the preferred form, the jaws have specially configured feet which engage apertures in the channel. Most preferably, the top wall and at least one sidewall of the channel have feet-engaging apertures so that the workpiece can be held by the jaws in both a horizontal and a vertical position.

In the illustrative embodiment, a hand crank extends outwardly of the end wall of the channel. The hand crank is integrally connected to a threaded shaft or screw which extends inwardly of the end wall within the interior area bounded by the channel and drives a box-like drive assembly. The drive assembly securely carries and moves one of the jaws in response to rotation of the hand crank.

A more detailed explanation of the invention is provided in the following description and appended claims taken in conjunction with the accompanying drawings.

DETAILED DESCRIPTION OF THE PREFERRED EMBODIMENT

Figure 1:
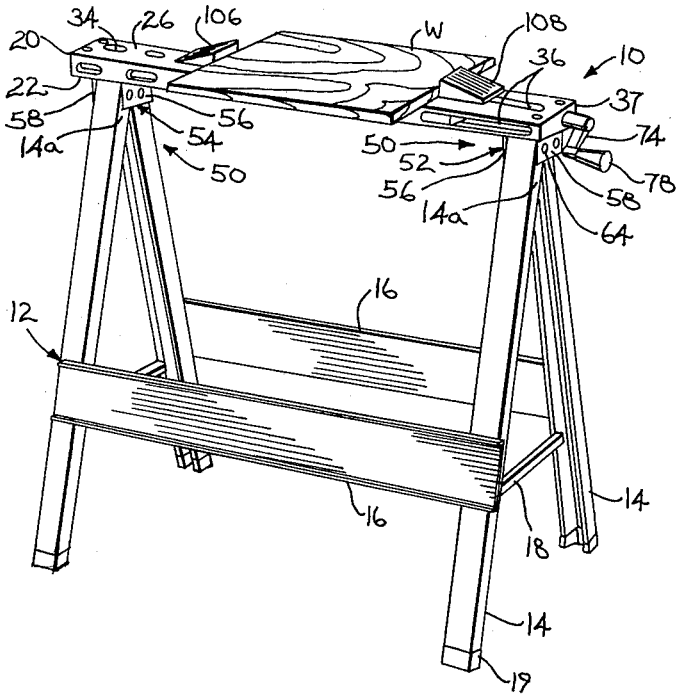
FIG. 1 is a perspective view of a vise mounted on a sawhorse and clamping a workpiece in accordance with principles of the present invention.

Referring now to FIG. 1 of the drawings, a portable detachable and removable vise or clamping assembly 10 is shown mounted on a collapsible or foldable sawhorse 12. Sawhorse 12 has legs 14, longitudinal braces 16, cross braces 18 and rubber feet 19 on the legs. Legs 14 and cross brace 18 at each end of the sawhorse forms an A-frame. Sawhorse 12 can be folded and hung for storage.

Figure 4:
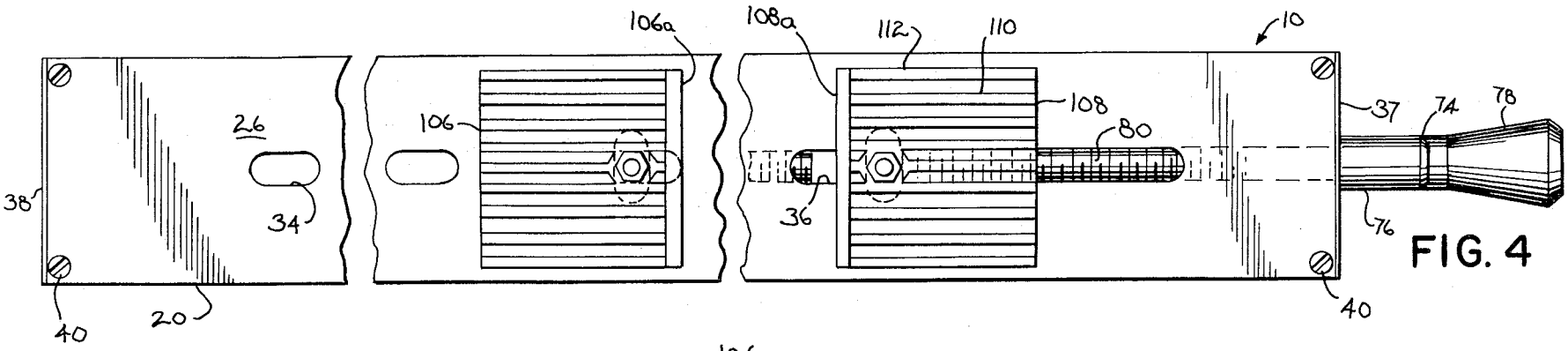
FIG. 4 is an enlarged fragmentary top view of the vise.
Figure 5:
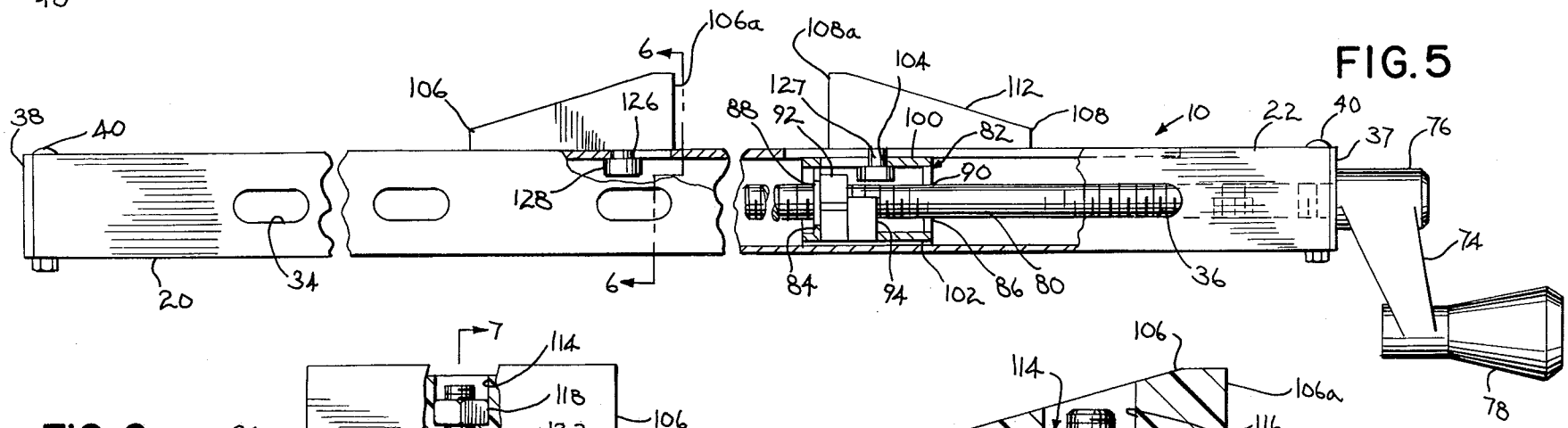
FIG. 5 is a fragmentary cross-sectional view of the side of the vise.

Vise 10 has an elongated inverted U-shaped slotted metal channel or rail 20 with elongated vertical sidewalls 22 and 24 (FIGS. 1 and 6) and an elongated longitudinal top wall 26 which extends between and connects sidewalls 22 and 24. The bottom edges 28 and 30 (FIG. 6) of each sidewall 22 and 24, respectively, are turned inwardly and upwardly and are spaced apart from each other to provide an access opening 32 into the bottom of channel 20. Each of the walls 22, 24 and 26 has longitudinally spaced oblong apertures or slots 34 which are elongated and aligned with each other in the longitudinal direction along the length of channel 20. In the illustrative embodiment, each of the walls has an elongated oblong aperture or slot 36 at the crank end of channel 20 which is eleven times longer than the other apertures 34 in channel 20. C-shaped end walls or rail end caps 37 and 38 (FIGS. 4 and 5) are connected to the ends of channel by bolts 40.

Connection assemblies 50 (FIG. 1) in the form of two inverted U-shaped metal connectors 52 and 54 are transversely welded or otherwise secured to the bottom of the channel's sidewalls. Connectors 52 and 54 removably mount channel 20 onto the legs 14 of sawhorse 12 so that the longitudinal wall 26 of channel 20 extends across and forms the top of sawhorse 12. Each connector has a pair of legs or flanges 56 and 58 (FIGS. 1 and 2) and a bight 60 which extends between and connects flanges 56 and 58. The edges 62 of the connector provide wall engaging portions. Flanges 56 and 58 are spaced a sufficient distance from each other to snugly abut and clamp against the top leg portions 14*a* (FIG. 1) of sawhorse 12. Bolts 64 (FIG. 1) fasten flanges 56 and 58 to top leg portions 14*a*.

Figure 2:
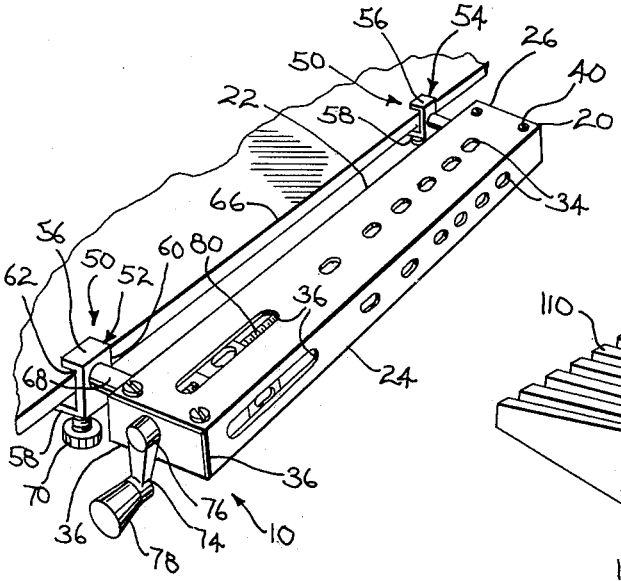
FIG. 2 is an enlarged perspective view of the vise connected to a workbench, but with the jaws removed.
Figure 3:
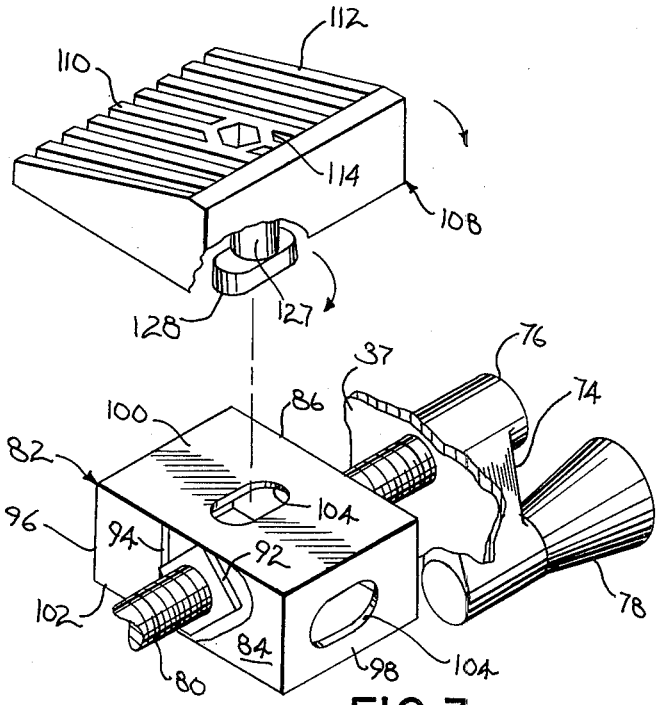
FIG. 3 is an enlarged assembly view of portions of the vise.

As shown in FIG. 2, connectors 52 and 54 can also be used to removably mount channel 20 to a workbench 66. In the illustrative embodiment, top wall 26 of channel 22 is mounted flush with the top surface of the workbench 66 to form aligned flat surfaces to support a workpiece. The workbench-engaging connectors 52 and 54 are secured to channel 20 via pedestals 68 and are fastened to the bottom of the workbench table via thumbscrews 70 or other fasteners. Flange 56 is positioned against the top surface of the table. In some circumstances, it may be desirable that fasteners be used with the top flange to engage the top surface of the workbench or that the connectors be secured directly to the channel without the use of pedestals.

Vise 10 has a rotatable hand crank 74 (FIGS. 2–5) with a hub portion or base 76 and a frustoconical crank handle 78. Base 76 extends outward of the end wall 36 at the crank end of channel 20. In the illustrative embodiment, hand crank is made of impact resistant plastic.

An elongated metal screw, threaded shaft or stud 80 (FIGS. 3–5) is fastened to the hub portion 76 of hand crank 74. Shaft 80 extends axially inwardly of end wall to a position within the interior area bounded by channel 20. In the illustrative embodiment, shaft 80 has left-hand threads and is chamfered at both ends. Shaft 80 threadingly engages and drives a box-like drive assembly 82 (FIG. 3) in response to rotation of hand crank 74.

Drive assembly 82 is generally rectangular in shape and has parallel shaft-receiving end walls 84 and 86 (FIGS. 3 and 5) with aligned shaft-receiving openings 88 and 90 (FIG. 5), respectively. An internally threaded nut 92 is secured against the left-hand end wall by an abutment member 94 or other connectors. Nut 92 threadingly engages, rides along, and is driven by the shaft 80. It may be desirable in some circumstances to use end walls with threaded openings which engage the threaded shaft in lieu of nut 92.

Box-like drive assembly 82 has apertured foot-engaging sidewalls 96 and 98, an apertured foot-engaging top wall 100 and bottom wall 102. The drive assembly top wall 102 and sidewalls 96 and 98 each have an elongated, oblong foot-receiving aperture or slot 104 that is similar in size and shape to a channel aperture 34. In the illustrative embodiment, each of the walls of the drive assembly is generally planar or flat. Drive assembly sidewalls 96 and 98 and top wall 100 are positioned parallel to channel sidewalls 22 and 24 and top wall 26, respectively. Drive assembly top wall 102 spans a lateral width slightly less than the internal width of channel's top wall 26 and moves linearly along threaded shaft 80 along part of the length of channel 20. The channel's sidewalls 22 and 24 prevent rotation of drive assembly 82 and help minimize wobbling of drive assembly 82. Both drive assembly 82 and shaft 80 are normally hidden from view within channel 20 to present a more pleasing appearance for vise 10.

In order to clamp and hold the workpiece W (FIG. 1), vise 10 has a pair of removable swivel jaws or clamps 106 and 108, including left-hand abutment jaw 106 (FIGS. 1, 4 and 5) and right-hand driven jaw 108. In the preferred embodiment, each jaw 106 and 108 is made of impact-resistant plastic and is in the form of a triangular shaped wedge with a plurality of inclined reinforcing ribs 110 (FIGS. 3 and 4) along its top or back 112.

Figure 7:
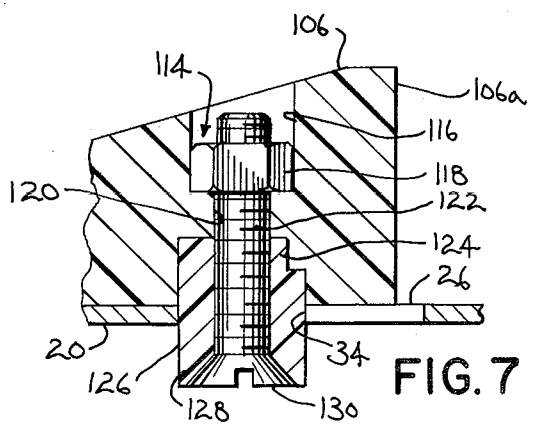
FIG. 7 is a cross-sectional view of the vise taken substantially along line 7—7 of FIG. 6.
Figure 6:
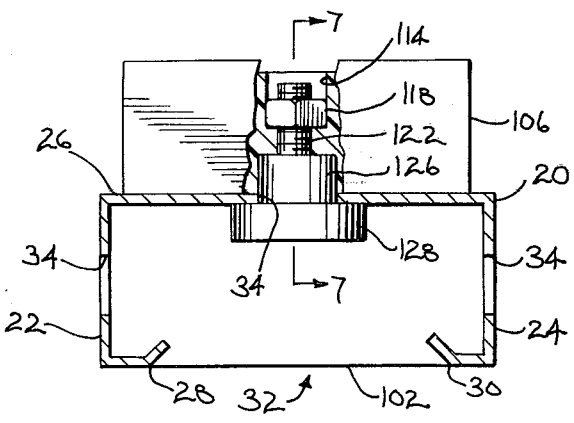
FIG. 6 is a cross-sectional view of the vise taken substantially along line 6—6 of FIG. 5.

As best shown in FIGS. 7 and 6, each jaw 106 and 108 has an axial bore 114 with an upper countersunk portion 116 to receive nut 118, a middle bolt-receiving portion 120 to receive bolt shank 122 and a lower stepped countersunk portion 124 to receive downwardly depending extension leg 126 or 127 FIGS. 3 and 5–7). Upper portion of leg 126 and 127 matingly engages and is stepped complementary to lower countersunk portion 124 to prevent it from turning when nut 118 is tightened on threaded shank 122. The bottom of each leg 126 and 127 has a transverse locking foot 128 (FIGS. 3 and 6) which is shaped complementary to but is slightly smaller than the shape and size of a channel slot 34 and drive assembly slot 104. The top and bottom surfaces of locking foot 128 are generally planar or flat and the lower portion of foot 126 is countersunk to receive bolt head 130 (FIG. 7). Foot 128 extends integrally from leg 126 or 127 in opposite directions so as to be positioned at right angles to the upright axis of leg 126 or 127. In the illustrative embodiment, feet 128 and legs 126 and 127 are made of impact-resistant plastic and have an inverted T-shaped cross section.

The leg 126 (FIGS. 5 and 6) of left-hand abutment jaw 106 is slightly longer than the wall thickness of channel 20 to enable foot 128 to be inserted into one of the channel slots 34 and be pivoted 90 degrees into locking engagement. The leg 127 of right-hand driven jaw 108 is longer than left-hand leg 126 and has a length slightly greater than the combined wall thicknesses of channel 20 and one of the foot-engaging walls 96, 98 or 102 of the drive assembly to permit its foot 126 to be inserted into both elongated channel slot 36 and an aligned drive assembly slot 104 so that it can be pivoted 90 degrees into locking engagement with drive assembly 82.

Each foot 128 has a length and width less than the length and width, respectively, of the slots 36 and 104 into which it is inserted. The length of each foot 128, however, is greater than the width of the slots into which it is inserted to substantially prevent the foot from being removed from channel 20 and/or drive assembly 82 when it is pivoted to a position in which its length extends across slots 36 and/or 104.

In use, foot 128 of the left-hand abutment jaw 106 is inserted into any channel slot 34 at the middle or left-hand portion of channel 20 (FIG. 1 away from crank) depending on the size of the workpiece. The foot 128 should be inserted on one of the sidewalls 22 or 24 if it is desired to hold the workpiece in a vertical position or in top wall 26 if it is desired to hold the workpiece in a horizontal position. Foot 128 is then pivoted 90 degrees to a transverse locking position and its leg 126 is moved against the outer wall of channel slot 34. In order to insert the right-hand jaw 108, hand crank 74 is rotated until the drive assembly slot 104 is located at a desired position along the elongated channel slot 36. The foot 128 of right-hand jaw 108 is then inserted into both the elongated channel slot 36 and drive assembly slot 104 and pivoted 90 degrees to a transverse locking position and its leg 127 is moved against the outer wall of drive assembly slot 104. When properly installed, the upright, workpiece-engaging surfaces 106*a* and 108*b* (FIG. 5) of jaws 106 and 108, respectively, face each other. The workpiece is then placed against the left-hand stationary jaw 106 and handle 78 of hand crank 74 is rotated to move the driven jaw 108 into clamping engagement with the workpiece. In order to remove the workpiece and the swivel jaws, the above procedure should be reversed.

Vise 10 is useful for hand or power sanding, precision sawing, assembly, locking scaffolds, gluing, planing, routing, drilling, mortising and repair of small and large items. Vise 10 is lightweight and portable and leaves both hands free to safely handle the working implements and tools.

While the described materials for the various parts and components of vise 10 are preferred, other materials can be used. Furthermore, the size and spacing of the slots and feet can be varied, if desired.

Although an embodiment of the invention has been shown and described, it is to be understood that various modifications and substitutions can be made by those skilled in the art without departing from the novel spirit and scope of this invention.

What is claimed is:

1. A vise comprising:

an elongated channel having a substantially inverted U-shaped cross section; said channel also having two spaced-apart, elongated sidewalls; said channel further having a longitudinal top wall extending between and connecting said sidewalls; each of said channel top and sidewalls defining a plurality of longitudinally spaced channel apertures;

at least one removable stationary jaw for engaging a portion of a workpiece and having a foot for detachably engaging said channel through one of said channel top or sidewall apertures;

a hand crank extending from said channel;

a threaded shaft connected to said hand crank and extending into said channel;

a drive assembly disposed within said channel and connected with said shaft; said drive assembly defining (1) a drive assembly aperture opening toward one of said channel sidewalls, (2) a drive assembly aperture opening toward the other of said channel sidewalls, and (3) a drive assembly aperture opening toward said channel top wall;

each said channel sidewall and channel top wall defining an elongate channel slot at the crank end of the channel, each said channel slot being generally in registry with an adjacent drive assembly aperture; and a removable adjustable jaw for engaging a portion of a workpiece opposite said removable stationary jaw, said removable adjustable jaw having a foot for detachably engaging one of said drive assembly apertures when said removable adjustable jaw foot has been inserted through one of said channel slots and into said one drive assembly aperture.

2. A vise in accordance with claim 1 in which said channel has one end wall normal to and connecting said channel top and sidewalls; in which said hand crank extends outwardly from said end wall; and in which said drive assembly is movable along the axis of said shaft and includes a shaft receiving means that is fixed relative to said drive assembly for receiving said shaft in threaded engagement whereby said drive assembly is driven by said shaft along said shaft in said channel in response to the rotation of said hand crank.

3. A vise comprising:

an elongated, channel having a substantially inverted U-shaped cross section; said channel also having two spaced-apart, parallel elongated sidewalls; said channel also having a longitudinal top wall normal to, extending between, and connecting said sidewalls; said channel further having at least one end wall normal to and connecting said top and sidewalls;

at least one removable stationary jaw for interlockingly engaging one of said walls and for engaging a portion of a workpiece;

said top and sidewalls defining a plurality of longitudinally spaced channel apertures, each channel aperture having a length greater than its width;

each removable stationary jaw having a foot for detachably engaging one of said channel top or sidewall apertures and a leg extending between and connecting said foot to said removable stationary jaw, said foot having a shape complementary to the shape of each said channel top and sidewall aperture and having a planar top surface;

said removable stationary jaw foot having a width less than the width of each said channel top and sidewall aperture and a length less than the length of each said channel top and sidewall aperture for enabling said removable stationary jaw foot to be inserted into one of said channel top and sidewall apertures, said length of said foot being greater than the width of each said channel side and top wall aperture for substantially preventing said foot from being removed when said removable stationary jaw foot has been inserted into said one channel aperture and pivoted to a position in which the foot length is located generally transverse to the width of said one channel aperture;

a hand crank extending outwardly of said channel end wall;

a threaded shaft connected to said hand crank and extending inwardly of said channel end wall;

a drive assembly disposed within said channel on said threaded shaft, said drive assembly having sidewalls parallel to said channel sidewalls, a top wall parallel to said channel top wall, and first and second end walls parallel to said channel end wall;

said shaft extending through said drive assembly first and second end walls; said drive assembly further including a shaft-receiving means retained in said drive assembly against movement relative to said drive assembly, said shaft-receiving means being threadingly engaged with said shaft for being driven with said drive assembly by said shaft in response to rotation of said hand crank;

each said drive assembly sidewall and said drive assembly top wall defining at least one drive assembly aperture having a length greater than its width;

each said channel sidewall and channel top wall defining an elongate channel slot at the crank end of the channel, each said channel slot being generally in registry with an adjacent drive assembly aperture;

a removable adjustable jaw for interlockingly engaging one of said drive assembly sidewalls or said drive assembly top wall for engaging a portion of a workpiece opposite said removable stationary jaw, said removable adjustable jaw having a foot for detachably engaging one of said drive assembly top or sidewall apertures and a leg extending between and connecting said removable adjustable jaw foot to said removable adjustable jaw, said removable adjustable jaw foot having a shape complementary to the shape of each said drive assembly top and sidewall apertures and having a planar top surface;

said removable adjustable jaw foot having a width less than the width of each said drive assembly top and sidewall aperture and a length less than the length of each said drive assembly top and sidewall aperture for enabling said removable adjustable jaw foot to be inserted into one of said drive assembly top and sidewall apertures, said length of said removable adjustable jaw foot being greater than the width of each said drive assembly top and sidewall aperture for substantially preventing said removable adjustable jaw foot from being removed when said removable adjustable jaw foot has been inserted through one of said channel slots and into one of said drive assembly top or sidewall apertures and pivoted to a position in which the length of the removable adjustable jaw foot is rotated generally transverse to the width of said one drive assembly top or sidewall aperture.

4. A vise in accordance with claim 3 wherein each said jaw includes a triangular shaped wedge with a plurality of ribs.

5. A vise in accordance with claim 3 wherein said slot in each said channel wall is substantially longer than each of the said channel apertures.

* * * * *